US006158533A

United States Patent [19]

Gillis et al.

[11] Patent Number: 6,158,533

[45] Date of Patent: Dec. 12, 2000

[54] ADJUSTABLE GAUGE DOWNHOLE DRILLING ASSEMBLY

[75] Inventors: Ian Gillis, Leduc, Canada; Gary M. Crase, Yucca Valley, Calif.; Laurier E. Comeau, Leduc; Charles M. Reid, Edmonton, both of Canada; Paul Roberts, Broussard, La.

[73] Assignee: Halliburton Energy Services, Inc., Houston, Tex.

[21] Appl. No.: 09/059,020

[22] Filed: Apr. 13, 1998

[30] Foreign Application Priority Data

Apr. 9, 1998 [CA] Canada ..... 2234495

[51] Int. Cl.[7] ..... E21B 7/08

[52] U.S. Cl. ..... 175/325.1; 175/73

[58] Field of Search ..... 175/61, 76, 73, 175/325.5, 325.2

[56] References Cited

U.S. PATENT DOCUMENTS

| | | | |
|---|---|---|---|
| 4,407,377 | 10/1983 | Russell . | |
| 4,491,187 | 1/1985 | Russell . | |
| 4,572,305 | 2/1986 | Swietlik | 175/325.4 |
| 4,848,488 | 7/1989 | Cendre et al. | 175/61 |
| 5,139,094 | 8/1992 | Prevedel et al. . | |
| 5,181,576 | 1/1993 | Askew et al. . | |
| 5,265,684 | 11/1993 | Rosenhauch . | |
| 5,293,945 | 3/1994 | Rosenhauch et al. | 175/325.2 |
| 5,520,255 | 5/1996 | Barr et al. | 175/24 |
| 5,542,482 | 8/1996 | Eddison | 175/61 |
| 5,706,905 | 1/1998 | Barr | 175/61 |

FOREIGN PATENT DOCUMENTS

| | | |
|---|---|---|
| 0163946 | 12/1985 | European Pat. Off. . |
| WO9007625 | 7/1990 | WIPO . |

OTHER PUBLICATIONS

Sperry–Sun Drilling Services, a division of Dresser Industries, Inc., Operations Manual for Adjustable Gauge Stabilizer (AGS™) dated 1997 (62 pages).

Sperry–Sun Drilling Services, Inc., catalogue entitled "Sourcebook", 1996, pp. 46–52 ("Downhole Motors") and pp. 53–55 ("Drilling Tools").

Sperry–Sun Drilling Services, Inc., "Sperry Drill Technical Information Handbook," undated, pp. 2–17.

*Primary Examiner*—Frank Tsay

*Attorney, Agent, or Firm*—Terrence N. Kuharchuk; Patrick H. McCollum; Eugene R. Montalvo

[57] ABSTRACT

A downhole drilling assembly including a housing having an upper end for connection to a drill string and a lower end, a fluid passage extending through the housing from the upper end to the lower end, a power unit contained within the housing, a drive assembly extending within the housing between the power unit and the lower end of the housing such that a mandrel chamber is defined between the drive assembly and the housing, a radially movable stabilizer associated with the housing, and an axially movable mandrel contained within the mandrel chamber, the mandrel being associated with a stabilizer actuator for causing radial movement of the stabilizer in response to axial movement of the mandrel.

25 Claims, 14 Drawing Sheets

ADJUSTABLE GAUGE DOWNHOLE DRILLING ASSEMBLY

TECHNICAL FIELD

The present invention relates to a downhole drilling assembly for use primarily in directional drilling which drilling assembly includes a downhole motor and incorporates an adjustable gauge stabilizer.

BACKGROUND OF THE INVENTION

Directional drilling involves controlling the direction of a wellbore as it is being drilled. Since wellbores are drilled in three dimensional space, the direction of a wellbore includes both its inclination relative to vertical as well as its azimuth. Usually the goal of directional drilling is to reach a target subterranean destination with the drill string.

It is often necessary to adjust the direction of the wellbore frequently while directional drilling, either to accommodate a planned change in direction or to compensate for unintended and unwanted deflection of the wellbore. Unwanted deflection may result from a variety of factors, including the characteristics of the formation being drilled, the makeup of the bottom hole drilling assembly and the manner in which the wellbore is being drilled. Directional drilling typically utilizes a combination of three basic techniques, each of which presents its own special features.

First, the entire drill string may be rotated from the surface, which in turn rotates a drilling bit connected to the end of the drill string. This technique is commonly used in non-directional drilling and in directional drilling where no change in direction is required or intended. This technique is relatively inexpensive because the use of specialized equipment such as downhole drilling motors can usually be kept to a minimum, but offers relatively little control over the direction of the wellbore.

Second, the drilling bit may be rotated by a downhole motor which is powered by the circulation of fluid supplied from the surface. This technique, sometimes called "sliding drilling", is typically used in directional drilling to effect a change in direction of a wellbore, such as in the building of an angle of deflection, and almost always involves the use of specialized equipment in addition to the downhole drilling motor, including bent subs or motor housings, steering tools and nonmagnetic drill string components. Furthermore, since the drill string is not rotated during sliding drilling, it is prone to sticking in the wellbore, particularly as the angle of deflection of the wellbore from the vertical increases. For this reason, and due also to the relatively high cost of sliding drilling, this technique is not typically used in directional drilling except where a change in direction is to be effected.

Third, rotation of the drill string may be superimposed upon rotation of the drilling bit by the downhole motor. Although this technique utilizes much of the specialized equipment used in the second technique, it may in some cases be cost effective because of the high drilling rates that can sometimes be achieved and also because a change from sliding drilling to the third technique and back again can be made without first tripping the drill string in and out of the wellbore.

The design of the bottom hole assembly of the drill string can enhance the effectiveness of all three of these techniques. In particular, in all three techniques the use of stabilizers in the bottom hole assembly can assist both in reducing unwanted deflection of a wellbore and in effecting a desired change in direction of the wellbore.

Conventional stabilizers can be divided into two broad categories. The first category includes rotating blade stabilizers which are incorporated into the drill string and either rotate or slide with the drill string. The second category includes non-rotating sleeve stabilizers which typically comprise a ribbed sleeve rotatably mounted on a mandrel so that during drilling operations, the sleeve does not rotate while the mandrel rotates or slides with the drill string. Rotating blade type stabilizers are far more common and versatile than non-rotating sleeve stabilizers, which tend to be used primarily in hard formations and where only mild wellbore deflections are experienced.

The primary purpose of using stabilizers in the bottom hole assembly is to stabilize the drilling bit that is attached to the distal end of the bottom hole assembly so that it rotates properly on its axis. When a bottom hole assembly is properly stabilized, the weight applied to the drilling bit can be optimized.

A secondary purpose of using stabilizers in the bottom hole assembly is to assist in steering the drill string so that the direction of the wellbore can be controlled. For example, properly positioned stabilizers can assist either in increasing or decreasing the deflection angle of the wellbore either by supporting the drill string near the drilling bit or by not supporting the drill string near the drilling bit.

Stabilizers are thus versatile tools which are useful in all three directional drilling techniques. The design of a bottom hole assembly requires consideration of where, what type and how many stabilizers should be incorporated into the drill string.

A single stabilizing point directly above the drill bit will tend to act as a pivot point for the drill string and may result in the drilling bit pushing to one side as weight on bit is increased, thus causing deflection of the wellbore. A second stabilizing point may reduce some of this effect, but preferably at least three stabilizing points are utilized if a straight wellbore is desired. The specific design of these stabilization points, which results in a "packed hole assembly", must be carefully determined in the context of the particular application.

In directional drilling applications, the pivot point provided by a near bit stabilizer can be used to advantage where deflection angle building is necessary. Alternatively, the deflection angle of the wellbore can sometimes be reduced by eliminating the near bit stabilizer but maintaining one or more stabilizers further up the drill string so that the drill string below the stabilizers will tend to drop down like a pendulum. This arrangement is sometimes referred to as a "packed pendulum assembly".

Since it is usually necessary to adjust the direction of the wellbore frequently during directional drilling, it can be seen that the desired number and location of stabilizers in the drill string may vary from time to time during drilling. Unfortunately, the entire drill string must first be removed from the wellbore in order to add or remove a conventional stabilizer to or from the drill string. This is extremely costly and time consuming.

Furthermore conventional rotating blade type stabilizers are not generally suited for use near the drilling bit in situations where a downhole motor is used to rotate the drill string, since the stabilizer is then rotated by the motor along with the drilling bit, which can result in excessive torque loading on the motor. In addition, the stabilizer may be damaged by being rotated in the wellbore at the speeds produced by downhole motors.

Some attempts have been made in the prior art to address these problems. None of these attempts, however, have provided a fully satisfactory solution.

U.S. Pat. No. 4,407,377 (Russell) and U.S. Pat. No. 4,491,187 (Russell) both describe an adjustable gauge surface controlled rotating blade type stabilizer in which the stabilizer blades can be alternated between retracted and extended positions by alternately circulating and not circulating fluid through the stabilizer body. The radial position of the stabilizer blades is controlled by a grooved barrel cam and a complementary pin which control the axial movement of an expander sleeve associated with the stabilizer blades while the fluid is alternately circulated and not circulated. The adjustable gauge stabilizer taught by Russell offers flexibility in drilling procedures since the stabilizer blades can be extended or retracted downhole without first removing the drill string from the wellbore. It is intended, however, to be connected directly into the drill string and is therefore not well suited for use as a near bit stabilizer in conjunction with a downhole drilling motor. Where the adjustable gauge stabilizer described in Russell is used with a downhole drilling motor it must be connected into the drill string above the drilling motor, which will place it a considerable distance from the drilling bit.

U.S. Pat. No. 5,139,094 (Prevedel et al) and U.S. Pat. No. 5,181,576 (Askew et al) both describe a downhole drilling assembly including a downhole motor and a near bit rotating blade type stabilizer with stabilizer blades that can be alternated between retracted and extended positions. The assembly includes a mandrel, a sleeve mounted on the mandrel for limited rotation relative to the mandrel, and radially movable members on the sleeve which are extended or retracted by relative rotation between the mandrel and the sleeve. The mandrel is further mounted on a spindle which is coupled to a drive shaft extending from the power section of the downhole motor. As a result, the assembly described in the Prevedel and Askew patents provides for adjustable stabilization near the drilling bit in circumstances where a downhole motor is used. It is, however, subject to some significant limitations.

First, the extension and retraction of the stabilizer blades is effected through rotation of the drill string relative to the mandrel. This limits the control that can be exercised over the radial position of the stabilizer blades in the course of different stages of drilling, since rotation of the drill string in one direction will extend the stabilizer blades and rotation of the drill string in the other direction will retract the stabilizer blades. As acknowledged in the Prevedel and Askew patents, this can be detrimental due to the tendency of the drill string to oscillate about its longitudinal axis when sliding drilling is being conducted. In addition, rotation of the drill string is only effective to extend and retract the stabilizer blades if the sleeve is in frictional contact with the wellbore so that the mandrel can rotate relative to the sleeve as the drill string rotates. This requirement may render the stabilizer ineffective in situations where the wellbore is washed out.

Second, the stabilizer blades cannot be locked in either of the extended or retracted positions, which further limits the control that can be exercised over the radial position of the stabilizer blades. For example, the stabilizer described in Prevedel and Askew is designed to move to the extended position when drilling is taking place entirely or partially through rotation of the drill string, and is designed to move to the retracted position when sliding drilling is occurring. These positions may be entirely inconsistent with the wishes of the drilling crew, but without a locking mechanism associated with the stabilizer blades there is no way to perform drilling with the drill string rotating while the stabilizer blades are in the retracted position and there is no way to perform sliding drilling with the stabilizer blades in the extended position.

U.S. Pat. No. 5,265,684 (Rosenhauch) and U.S. Pat. No. 5,293,945 (Rosenhauch et al) describe a downhole adjustable rotating blade type stabilizer similar to that described in the Russell patents, in that the radial position of the stabilizer blades can be alternated between extended and retracted positions by circulating or not circulating fluid through the stabilizer body. Instead of a barrel cam and complementary pin, however, the adjustable stabilizer described in Rosenhauch uses a locking sleeve to fix the stabilizer blades in either the extended or retracted positions. This adjustable stabilizer appears to share the same disadvantages as the stabilizer described in Russell, in that it must be connected into the drill string above the downhole motor for directional drilling applications. A further disadvantage of the stabilizer described in Rosenhauch is that a two step procedure is necessary to extend and retract the stabilizer blades, since the stabilizer blades must be moved radially and the locking sleeve must be moved into or out of position.

Finally, Sperry-Sun Drilling Services, a division of Dresser Industries, Inc. manufactures an adjustable gauge rotating blade type stabilizer known as the Sperry-Sun AGS (TM) which is similar in principle to the adjustable stabilizer described in the Russell patents. In the Sperry-Sun AGS (TM), the radial position of the stabilizer blades is controlled by a grooved barrel cam and a complementary pin which control the axial movement of a series of ramps associated with the stabilizer blades while fluid is alternately circulated and not circulated through the stabilizer body. The Sperry-Sun AGS (TM) also includes a mechanism for signalling to the surface by using the pressure drop of the circulating fluid through the stabilizer body whether the stabilizer blades are in the extended or retracted position. For applications where a downhole drilling motor is used, the Sperry-Sun AGS (TM) must be connected into the drill string above the downhole motor, a significant distance from the drilling bit, and thus cannot be used in such applications as a near bit stabilizer.

There is therefore a need in the drilling industry for a stabilizer having one or more stabilizer elements which can be moved radially, which stabilizer can be connected into a drill string between the power unit of a downhole motor and the drilling bit.

SUMMARY OF THE INVENTION

The present invention relates to a downhole drilling assembly of the type which includes a downhole motor for driving a drilling bit without rotating the drill string to which the drilling assembly is connected. It further relates to a downhole drilling assembly in which a stabilizer is included between the power unit of the downhole motor and connection point for the drilling bit. The stabilizer is movable radially and is preferably adjustable between one or more retracted positions and one or more extended positions.

More particularly, the invention relates to a downhole drilling assembly comprising a housing having an upper end for connection to a drill string and a lower end, a fluid passage extending through the housing from the upper end to the lower end, a power unit contained within the housing, a drive assembly extending within the housing between the power unit and the lower end of the housing such that a mandrel chamber is defined between the drive assembly and the housing, a radially movable stabilizer associated with the housing, and an axially movable mandrel contained within the mandrel chamber, the mandrel being associated with a stabilizer actuator for causing radial movement of the stabilizer in response to axial movement of the mandrel.

Preferably, the drive assembly is rotatable relative to the housing. Preferably the mandrel is urged toward the lower end of the housing in response to a fluid being passed through the fluid passage from the upper end of the housing toward the lower end of the housing. Preferably the stabilizer is capable of moving radially between at least one retracted position and at least one extended position.

Preferably the drilling assembly further comprises a biasing device for urging the mandrel toward the upper end of the housing. In the preferred embodiment, the biasing device comprises a spring or springs contained in the mandrel chamber which act upon both the housing and the mandrel.

The mandrel may have an upper end which communicates with the fluid passage so that the mandrel is urged toward the lower end of the housing in response to the fluid being passed through the fluid passage from the upper end of the housing toward the lower end of the housing.

The stabilizer may include an inner radial surface which extends into the mandrel chamber when the stabilizer is in a retracted position. The stabilizer may include one or more pistons which are moved radially by the stabilizer actuator. The stabilizer may also comprise one or a plurality of stabilizer elements which are spaced circumferentially around the housing. In the preferred embodiment the stabilizer includes three stabilizer elements. Each stabilizer may comprise a set of pistons spaced axially along the housing. In the preferred embodiment each stabilizer element includes four pistons. The set of pistons may be spaced linearly or they may be spaced in a spiral or other configuration. One or more of the stabilizer elements may further comprise a stabilizer blade connected to the set of pistons. Each stabilizer element or piston may extend an equal distance to its extended position, or this distance may vary between stabilizer elements or pistons.

Preferably the stabilizer actuator comprises a ramped outer surface for engagement with the inner radial surface of the stabilizer to effect radial movement of the stabilizer. Preferably the ramped outer surface increases in radial dimension in a direction toward the upper end of the housing.

In the preferred embodiment, the stabilizer actuator comprises a set of axially spaced ramp rings which move axially with the mandrel, with an equal number of ramp rings to the number of pistons in a set of pistons. Each ramp ring therefore actuates a separate piston in a set of pistons. In the preferred embodiment, where there are four pistons in each set of pistons and three stabilizer elements, there are four ramp rings and each ramp ring actuates one piston in each of the three sets of pistons.

The drilling assembly may further comprise a balancing piston assembly associated with the mandrel chamber. Preferably the balancing piston assembly includes a wellbore fluid compartment and an oil compartment within the mandrel chamber which oil compartment is defined by a bulkhead at a first end and a balancing piston at a second end. In the preferred embodiment, the oil compartment contains the springs of the biasing device, the barrel cam and its bearings, and the set of ramp rings. In the preferred embodiment, the oil compartment is filled with oil and serves to lubricate the springs of the biasing device, the barrel cam and its bearings, the ramp rings and pistons, and also serves to provide that when the drilling assembly is in use, a pressure exerted on an outer radial surface of the stabilizer is substantially the same as a pressure exerted on the inner radial surface of the stabilizer.

Preferably a wellbore fluid port, which preferably includes a filter plug to prevent solid material from entering the drilling assembly, is included on the housing. The wellbore fluid port preferably communicates with the balancing piston to transmit wellbore pressure to the balancing piston and thus the oil compartment. In the preferred embodiment, the wellbore fluid compartment and the oil compartment are designed so that the balancing piston will move equally with the mandrel so that the volume of wellbore fluid contained in the wellbore fluid compartment is constant for any axial position of the mandrel.

Preferably the drilling assembly includes an indexing mechanism associated with the mandrel. In the preferred embodiment, the indexing mechanism provides for a first maximum downward position of the mandrel in which the stabilizer is in a retracted position, a second maximum downward position of the mandrel in which the stabilizer is in an extended position, and a maximum upward position in which the stabilizer is in a rest position. In the preferred embodiment the indexing mechanism comprises a barrel cam rotatably contained in the mandrel chamber and axially movable with the mandrel and a barrel cam pin associated with the housing which engages a groove in the barrel cam to control the axial movement of the mandrel. In the preferred embodiment, there is a stop lug associated with the housing and a first shoulder, a second shoulder and a third shoulder associated with the barrel cam. The stop lug engages the first shoulder when the mandrel is at the first maximum downward position, engages the second shoulder when the mandrel is at the second maximum downward position and engages the third shoulder when the mandrel is at the maximum upward position.

Preferably the drilling assembly includes a signalling device for signalling whether the mandrel is in the first maximum downward position or in the second maximum downward position. In the preferred embodiment, the signalling device comprises a flow diverter associated with the fluid passage which causes the pressure drop experienced by fluid which passes through the fluid passage to be different depending upon whether the mandrel is in the first maximum downward position or the second maximum downward position. In the preferred embodiment, the flow diverter cooperates with the mandrel to change the cross section of the fluid passage depending upon the axial position of the mandrel.

Preferably, the drive assembly is supported in the housing by at least one bearing. In the preferred embodiment, the drive assembly is supported by a thrust bearing assembly and by three radial bearings which are spaced axially within the housing. Finally, the drilling assembly may include a drilling bit attached to the drive assembly adjacent to the lower end of the housing.

BRIEF DESCRIPTION OF DRAWINGS

Embodiments of the invention will now be described with reference to the accompanying drawings, in which.

DETAILED DESCRIPTION

Figure 1:
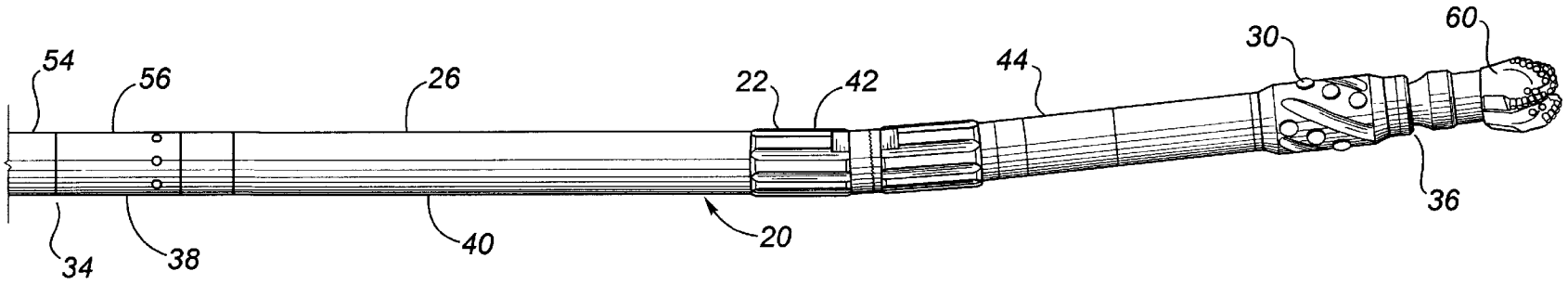
FIG. 1 is a side view schematic drawing of a preferred embodiment of a drilling assembly according to the present invention.
Figure 2A:
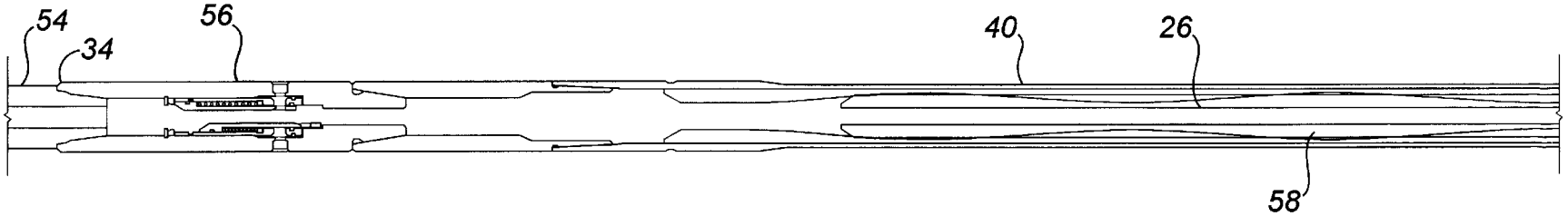
FIG. 2 is a partial longitudinal section view of the drilling assembly depicted in FIG. 1 with the stabilizer in an extended position.
Figure 2B:
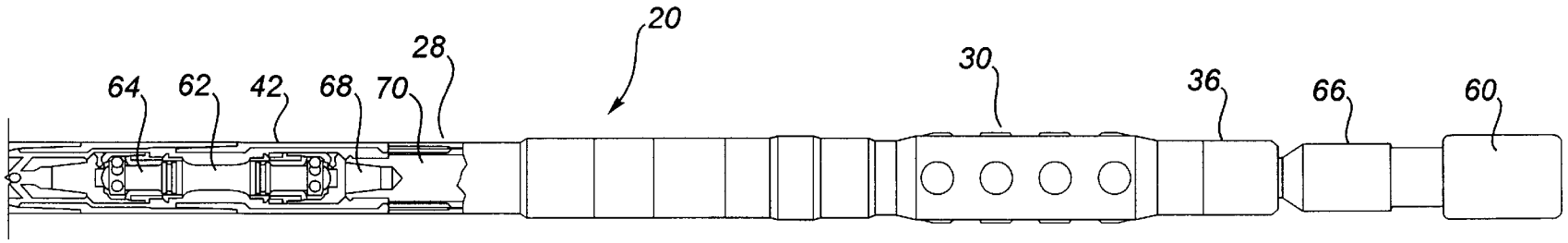

The present invention relates to a downhole drilling assembly for connection to a drill string. It includes a drilling motor for driving a drilling bit and an adjustable gauge stabilizer which is located between the power unit of the motor and the connection point for the drilling bit.

Conventional downhole motor assemblies comprise a downhole motor connected to a drive shaft. During drilling operations, the motor assembly is connected to the end of a drill string and a drilling bit is connected to the end of the drive shaft so that the drilling bit can be driven by the motor without rotation of the drill string.

A typical downhole motor assembly includes several component parts connected end to end. These parts usually include a power unit, a transmission unit for connecting the power unit to the drive shaft, a bearing section for supporting the power unit and the drive shaft, and a housing for containing the drive shaft. The housing and the transmission unit may be straight or they may be bent. They may also be adjustable between straight and bent configurations.

A conventional motor assembly may also include a non-adjustable stabilizer either as part of the housing or as a separate component connected to the housing. Another optional feature of a conventional motor assembly is a dump sub which is connected above the power unit. The dump sub typically contains a valve which is ported to allow fluid flow between the drill string and the annulus when the motor assembly is downhole.

The present invention combines a conventional downhole motor assembly with an adjustable gauge stabilizer into one downhole drilling assembly. In its preferred embodiment, and referring to FIG. 1 through FIG. 11, the downhole drilling assembly (20) of the present invention generally includes a housing (22), a fluid passage (24), a power unit (26), a drive assembly (28), a stabilizer (30) and a mandrel (32).

The main function of the housing (22) is to contain and protect the various components of the assembly (20). In the preferred embodiment, the housing (22) includes an upper end (34) and a lower end (36) and consists of a number of tubular sections connected together with threaded connections. From the upper end (34) to the lower end (36), these sections include a dump sub housing (38), a power unit housing (40), a transmission unit housing (42), a bearing housing (44), a lower bearing sub (46), an indexing housing (48), a piston housing (50) and a bottom housing cap (52). The fluid passage (24) extends through the interior of the housing (22) from the upper end (34) to the lower end (36). The upper end (34) of the housing (22) is threaded to enable the assembly (20) to be connected to a drill string (54). One or more sections of the housing (22), preferably either the transmission unit housing (42) or the indexing housing (48), may comprise either a fixed bent housing section or an adjustable bent housing section.

In the preferred embodiment, the assembly (20) includes a conventional dump sub (56) which as in conventional downhole motor assemblies permits fluid flow between the drill string (54) and the wellbore under certain conditions when the assembly (20) is downhole. The dump sub (56) is optional, and any type of dump sub (56) or equivalent device may be used with the invention if so desired. If no dump sub (56) is included in the assembly (20), the power unit (26) may be connected directly to the drill string (54), in which case the upper end (34) of the housing (22) is the upper end of the power unit housing (40).

The power unit (26) is contained within the power unit housing (40), and in the preferred embodiment comprises a conventional downhole motor which converts hydraulic energy derived from circulating fluid into mechanical energy in the form of a rotating rotor shaft (58). Other types of downhole motors, including electric motors, may however be used in the invention as long as they can provide the requisite rotational energy.

The main function of the drive assembly (28) is to transmit rotational and thrust energy from the power unit (26) to a drilling bit (60) which is connected to the drive assembly (28) when the assembly (20) is in use. The drive assembly (28) is rotatable relative to the housing (22).

In the preferred embodiment, the drive assembly (28) comprises a transmission shaft (62) which is connected to the rotor shaft (58) by an upper articulated connection (64) and a drive shaft (66) which is connected to the transmission shaft (62) by a lower articulated connection (68). The transmission shaft (62), the upper articulated connection (64) and the lower articulated connection (68) are all contained within the transmission unit housing (42). The use of the articulated connections (64, 68) helps to eliminate eccentric motions of the rotor shaft (58) as well as effects caused by the use of bent housing sections as part of the assembly (20).

The drive shaft (66) extends through the interior of the bearing housing (44), the lower bearing sub (46), the indexing housing (48), the piston housing (50) and protrudes through the bottom housing cap (52) past the lower end (36) of the housing (22). In the preferred embodiment, the drive shaft (66) includes a drive shaft cap (70) which is coupled with a threaded connection to the transmission shaft (62) by the lower articulated connection (68). The drive shaft cap (70) in turn is coupled with a threaded connection to a flow diverter shaft (72) which in turn is coupled with a threaded connection to a lower drive shaft (74). The lower drive shaft (74) has a lower end (76) which has a box connection into which may be connected the drilling bit (60).

The flow diverter shaft (72) and the lower drive shaft (74) both have a hollow bore so that circulating fluid such as drilling mud can pass through the interior of the drive shaft (66). As a result, the fluid passage (24) extends primarily through the interior of the drive shaft (66) between an arrangement of fluid inlet ports (78) located on the drive shaft cap (70) and the lower end (76) of the lower drive shaft (74). In the preferred embodiment there are four fluid inlet ports (78) spaced equally around the circumference of the drive shaft cap (70), but other arrangements and numbers of fluid inlet ports (78) may be used. The fluid inlet ports (78) permit circulating fluid to pass from the annular space around the exterior of the drive shaft cap (78) into the hollow interior bore of the drive shaft (66). A small amount of circulating fluid may also pass through the annular space surrounding the drive shaft (66) along most of the length of the drive shaft (66). This small amount of circulating fluid serves primarily to lubricate some of the components of the assembly (20).

The stabilizer (30) is radially adjustable and is actuated by axial movement of the mandrel (32). The mandrel (32) is contained in a mandrel chamber (80) which is defined by an annular space between the drive shaft (66) and the interior of the housing (22). In the preferred embodiment, the mandrel chamber (80) extends for most of the length of the indexing housing (48) and the piston housing (50). More particularly, in the preferred embodiment the mandrel chamber (80) is defined at one end by the connection between the lower bearing sub (46) and the indexing housing (48) and at the other end by the connection between the piston housing (50) and the bottom housing cap (52). A bulkhead (82) is contained in the mandrel chamber (80) adjacent to the connection between the piston housing (50) and the bottom housing cap (52).

The mandrel (32) has an upper end (84) and a lower end (86), and includes a number of tubular sections connected together with threaded connections. From its upper end (84) to its lower end (86) the mandrel (32) includes an upper mandrel (88), a spring mandrel (90) connected to the upper mandrel (88), a mid bearing mandrel (91) connected to the spring mandrel (90), a nut mandrel (92) connected to the mid bearing mandrel (91), a barrel cam mandrel (94) connected to the nut mandrel (92), and a lower mandrel (96) connected to the barrel cam mandrel (94). The mandrel (32) is capable of limited axial movement within the mandrel chamber (80) in order to actuate the stabilizer (30). Each of the sections of the mandrel (32) performs a specific function in the operation of the assembly (20).

Figure 12:
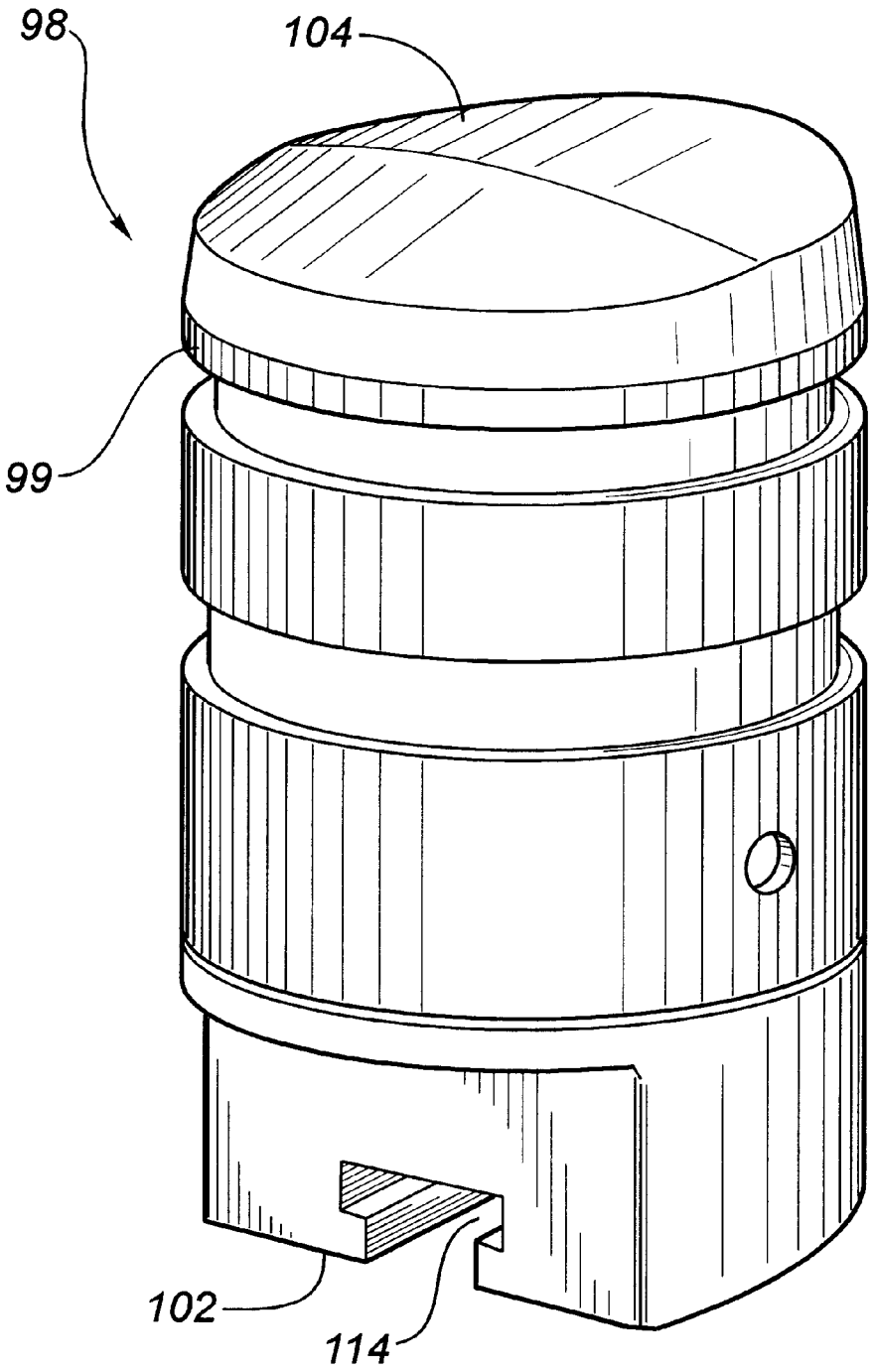
FIG. 12 is a pictorial view of a stabilizer piston according to a preferred embodiment of the present invention.

The stabilizer (30) is associated with the piston housing (50). In the preferred embodiment the stabilizer (30) comprises pistons (98) positioned in piston seats (100) in the piston housing (50). Referring to FIG. 12, each piston (98) has an inner radial surface (102) and an outer radial surface (104). The piston seats (100) extend through the piston housing (50) into the mandrel chamber (80) so that the inner radial surface (102) of each piston (98) interfaces with the mandrel chamber (32) and the outer radial surface (104) of each piston (98) interfaces with the exterior of the piston housing (50). Each of the pistons (98) includes a piston seal (99) for providing a seal between the piston (98) and its corresponding piston seat (100).

Figure 6A:
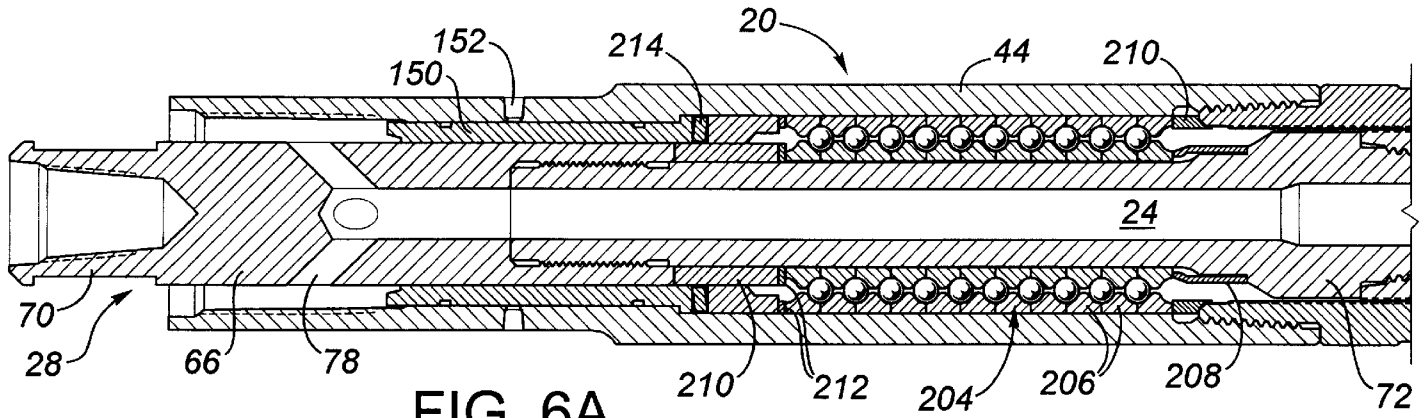
FIGS. 6, 7 and 8 together constitute a detailed longitudinal section view of the drilling assembly of FIG. 1 with the stabilizer in a retracted position, with FIG. 7 being a continuation of FIG. 6 and FIG. 8 being a continuation of FIG. 7.
Figure 6B:
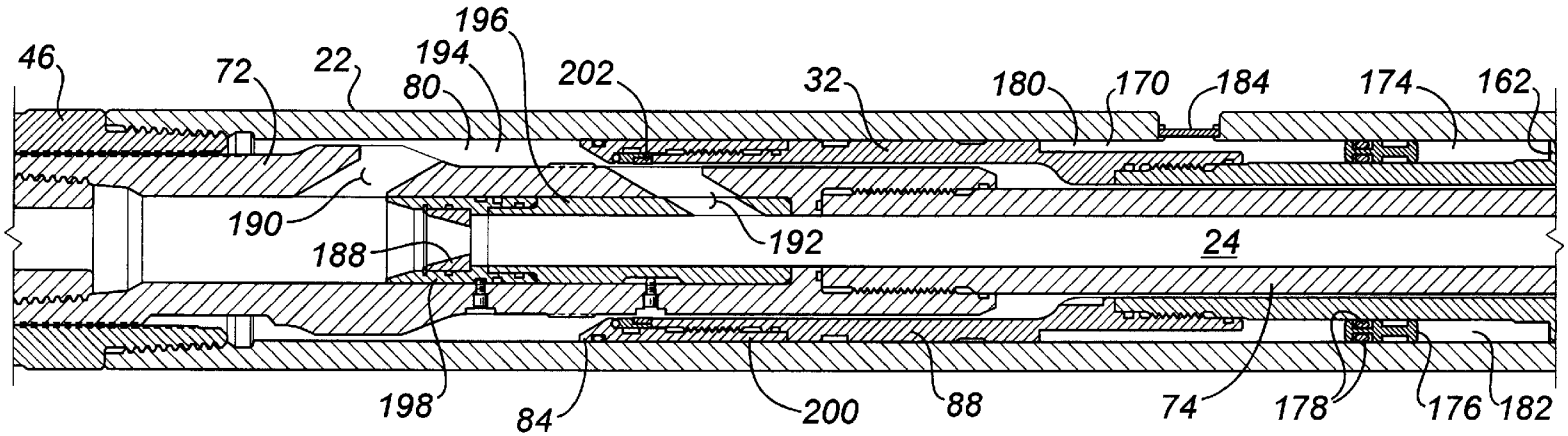
Figure 7A:
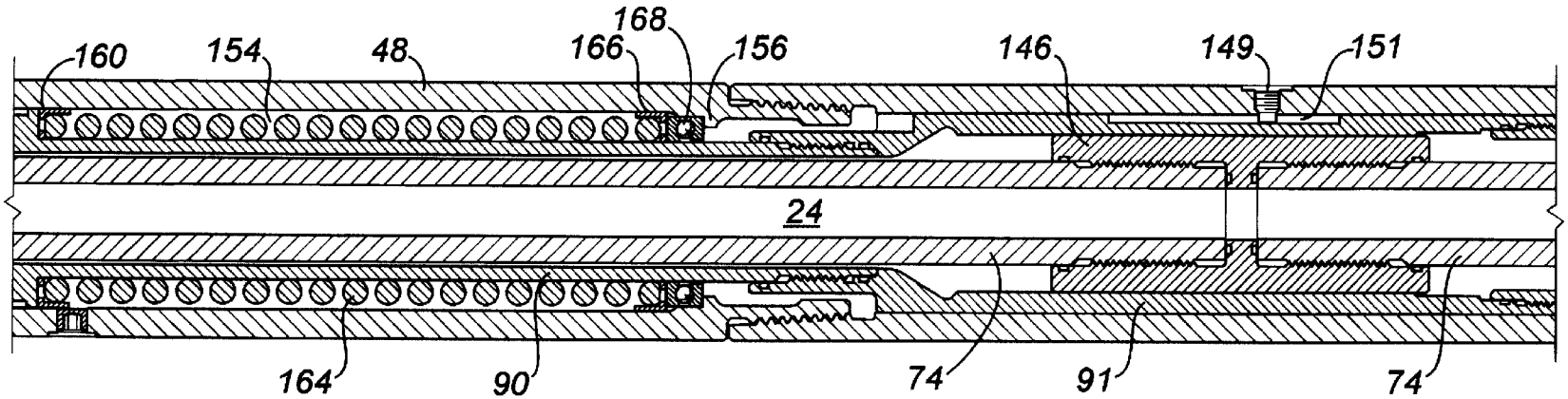
Figure 7B:
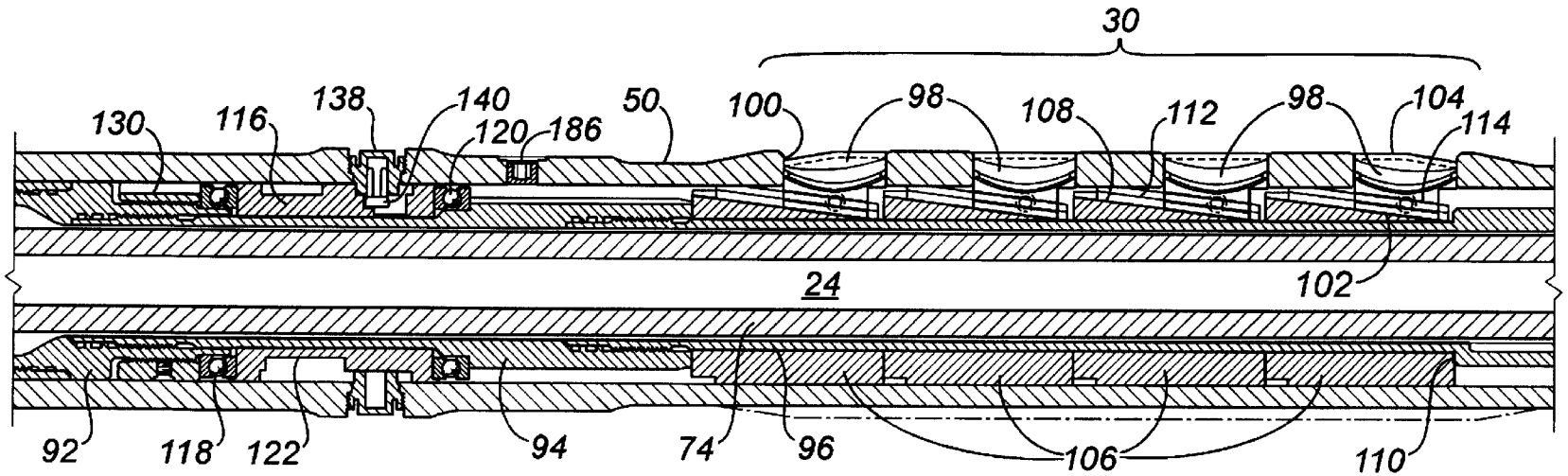
Figure 8:
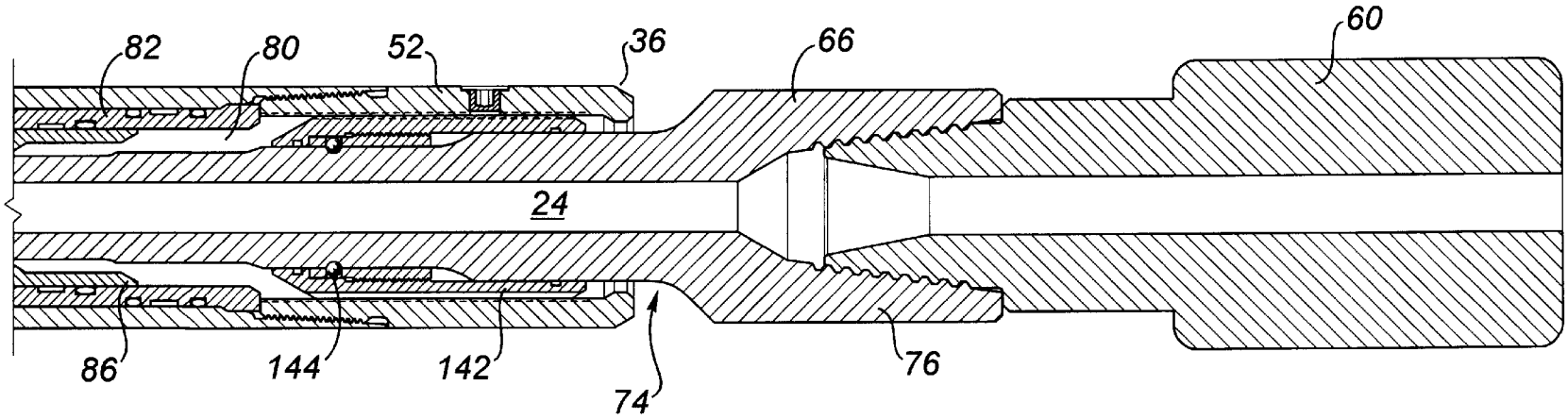
Figure 9A:
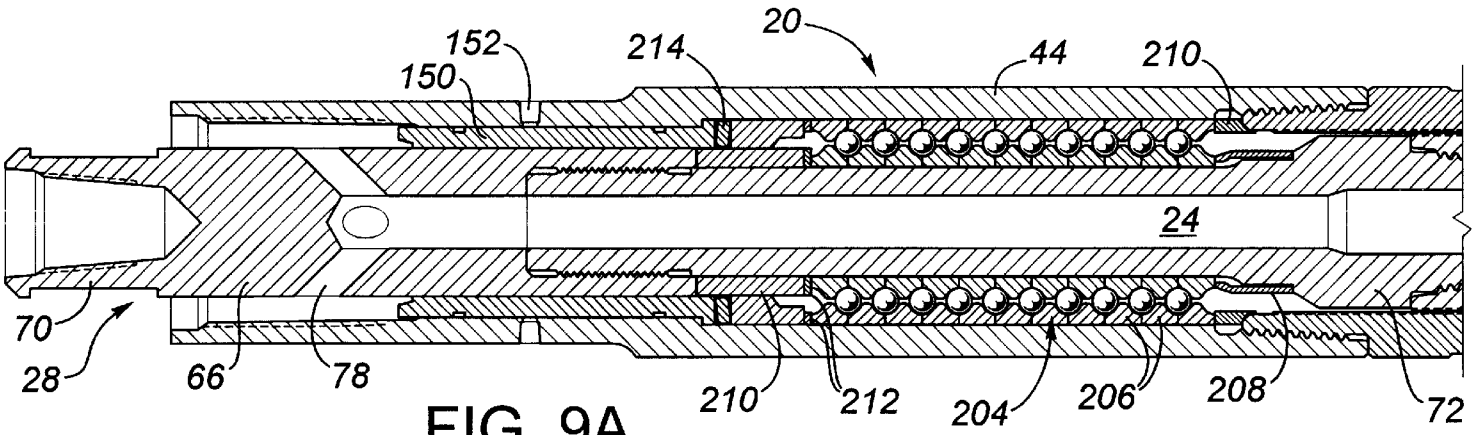
FIGS. 9, 10 and 11 together constitute a detailed longitudinal section view of the drilling assembly of FIG. 1 with the stabilizer in a rest position, with FIG. 10 being a continuation of FIG. 9 and FIG. 11 being a continuation of FIG. 10.
Figure 9B:
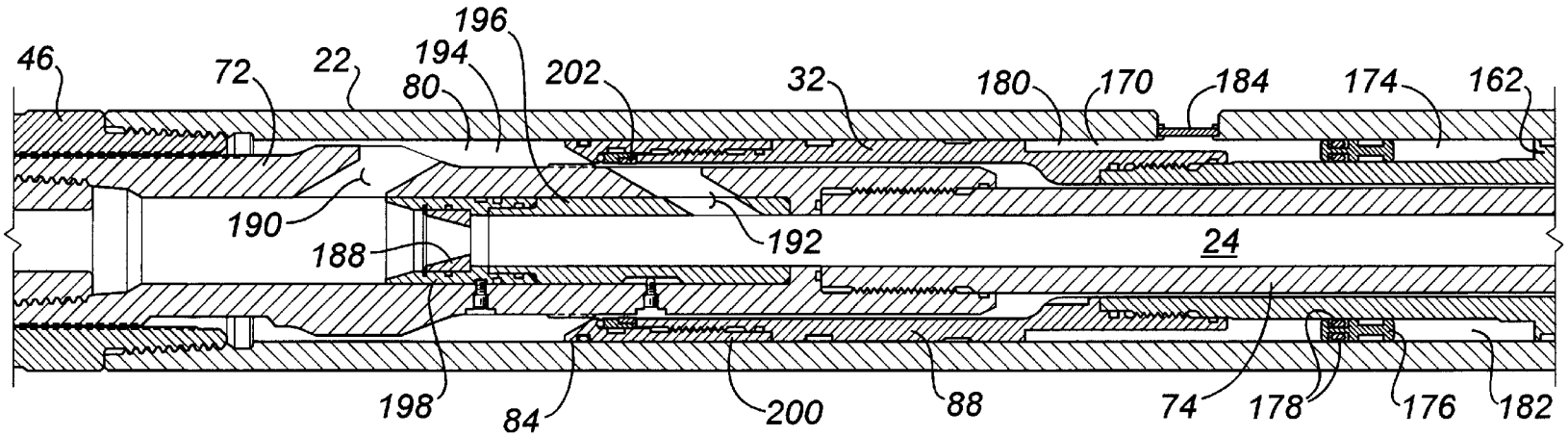
Figure 10A:
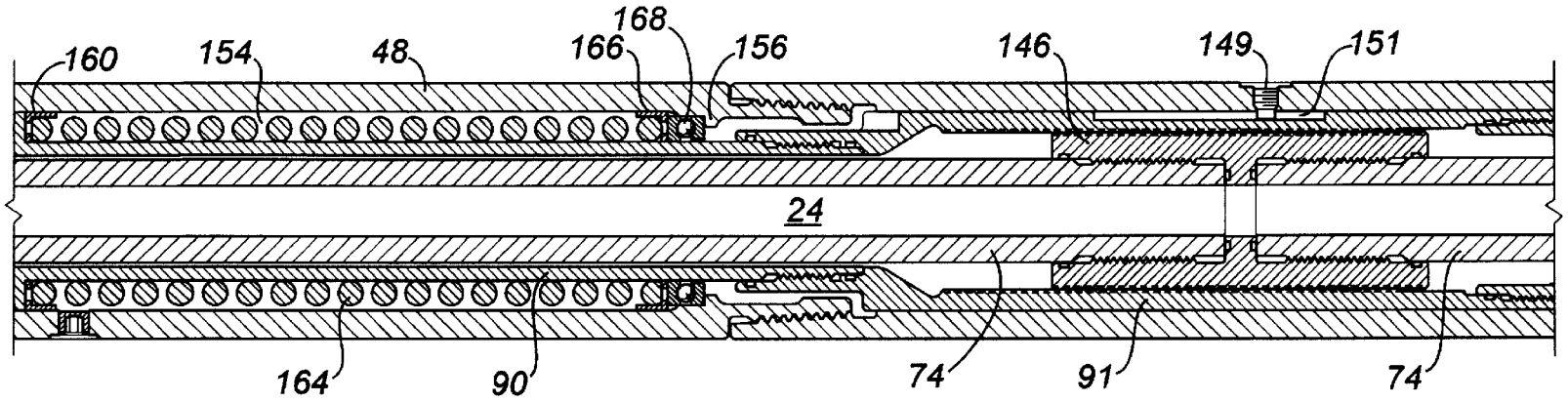
Figure 10B:
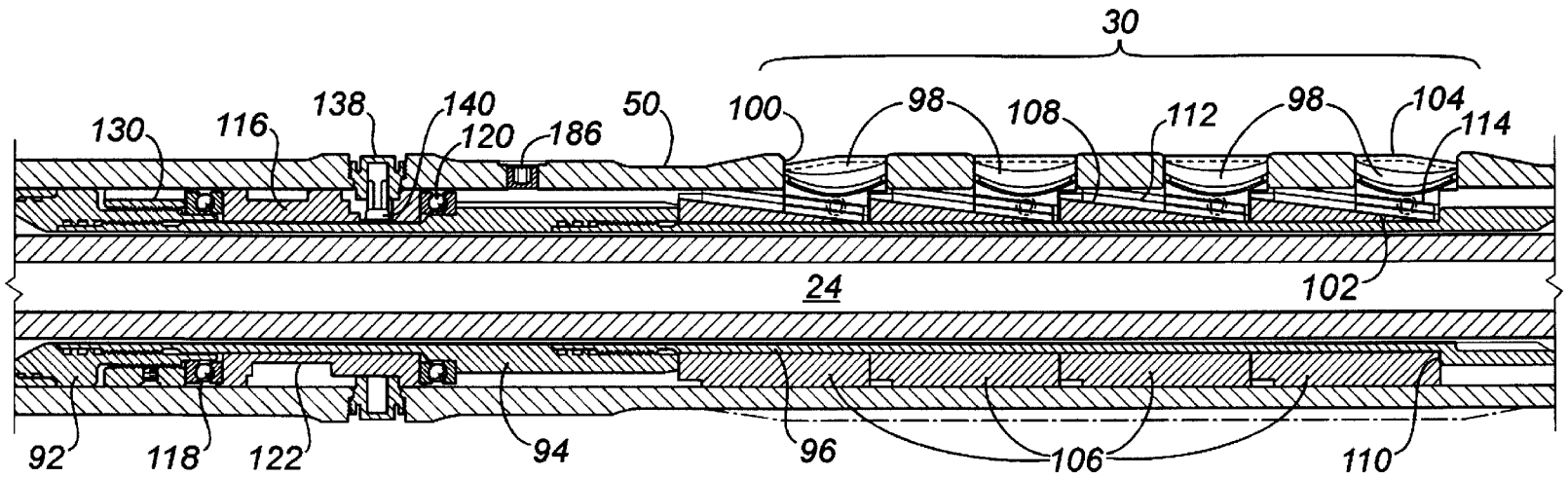
Figure 11:
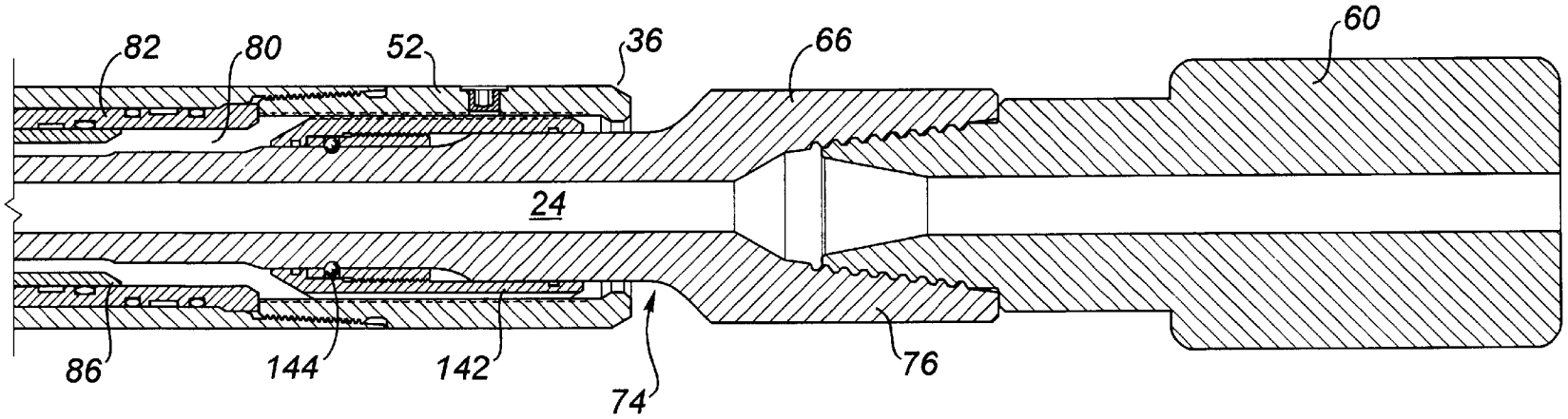

In the preferred embodiment, the pistons (98) are capable of radial movement relative to the piston housing (50) between a number of different positions, including a retracted position and an extended position. In the retracted position, the outer radial surfaces (104) of the pistons (98) are flush with the exterior of the piston housing (50) and the inner radial surfaces (102) of the pistons (98) extend into the mandrel chamber (80). In the extended position, the outer radial surfaces (104) of the pistons (98) protrude outward from the exterior of the piston housing (50). In the preferred embodiment, the pistons (98) are also capable of movement into a rest position in which the outer radial surfaces (104) of the pistons (98) are withdrawn slightly inside the exterior of the piston housing (50). FIGS. 2 through 5 depict the assembly (20) in the extended position. FIGS. 6 through 8 depict the assembly (20) in the retracted position. FIGS. 9 through 11 depict the assembly (20) in the rest position.

The radial position of the stabilizer (30) is determined by a stabilizer actuator which is associated with the mandrel (32) and which causes radial movement of the stabilizer (30) in response to axial movement of the mandrel (32).

Figure 13:
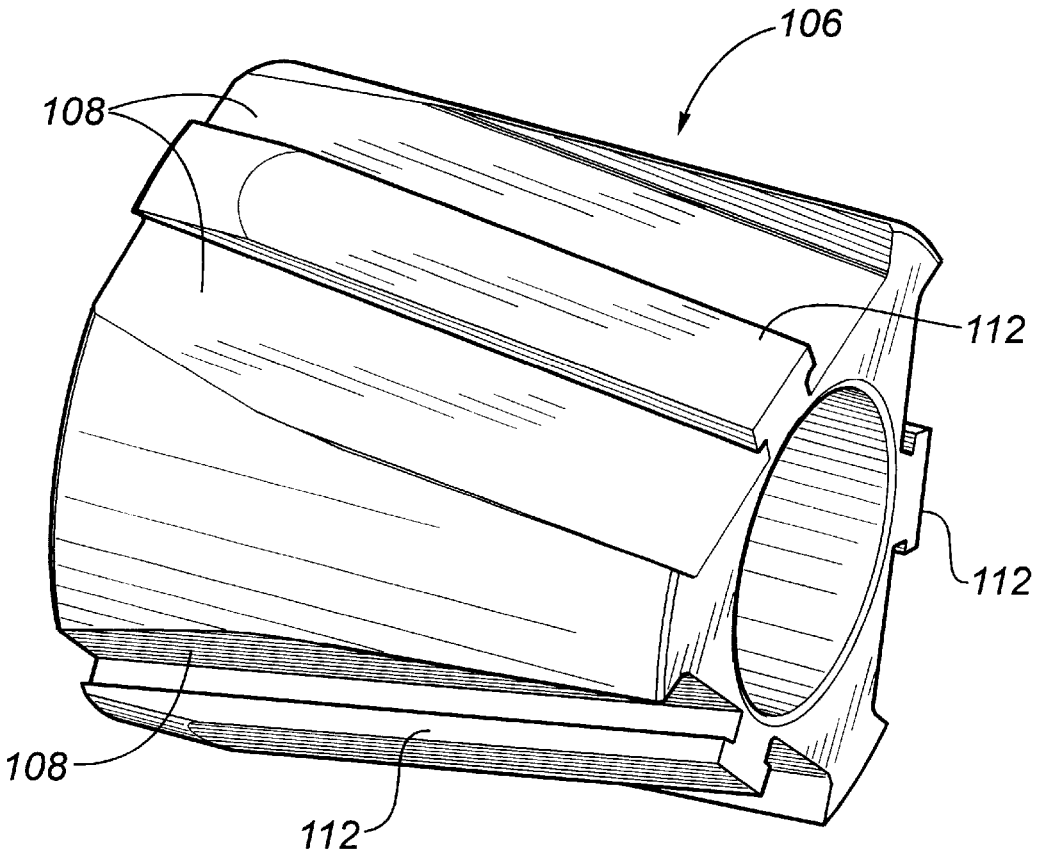
FIG. 13 is a pictorial view of a ramp ring according to a preferred embodiment of the present invention.

Referring to FIG. 13, in the preferred embodiment the stabilizer actuator comprises a set of ramp rings (106) having ramped outer surfaces (108) which engage the inner radial surfaces of the pistons (98). The ramp rings (106) are tubular collars which are mounted on a narrow section of the lower mandrel (96) between a shoulder (110) on the lower mandrel (96) and the point of connection between the lower mandrel (96) and the barrel cam mandrel (94) such that the ramp rings (106) move axially with the mandrel (32).

The ramped outer surfaces (108) of the ramp rings (106) extend into the mandrel chamber (80) in order to engage the inner radial surfaces (102) of the pistons (98) and are arranged so that their ramped outer surfaces (108) increase in radial dimension in a direction toward the upper end (34) of the housing (22) so that the pistons (98) are moved radially outward in response to movement of the mandrel (32) toward the lower end (36) of the housing (22). The pistons (98) are maintained in engagement with the ramp rings (106) by tracks (112) on the outer ramped surfaces (108) of the ramp rings (106) which engage complementary grooves (114) in the inner radial surfaces of the pistons (98). The pistons (98) slide along the grooves (114) in response to axial movement of the mandrel (32).

In the preferred embodiment, the stabilizer (30) includes three stabilizer elements spaced circumferentially around the piston housing (50). Each stabilizer element in turn includes a set of pistons (98) spaced axially along the piston housing (50). In the preferred embodiment, each set of pistons (98) includes four pistons so that the stabilizer therefore includes twelve pistons (98) spaced circumferentially and axially on the piston housing (50).

In the preferred embodiment, the stabilizer actuator includes four ramp rings (196) so that a separate ramp ring (106) actuates each piston (98) in a set of pistons (98). In addition, each ramp ring (106) actuates one piston (98) in each of the three stabilizer elements so that three pistons (98) are therefore actuated by each ramp ring (106), and each of the three stabilizer elements and each of the twelve pistons (98) making up the three stabilizer element extends and retracts the same radial distance in response to axial movement of the mandrel (32).

Any number, configuration and shape of stabilizer elements, pistons (98) and ramp rings (106) may however be used in the assembly (20). In particular, the pistons (98) in a set of pistons (98) may be spaced axially in a straight line or in a spiralling line depending upon the stabilizer requirements. In the preferred embodiment, the pistons (98) are spaced axially in a straight line.

The stabilizer elements and pistons (98) may also be designed to extend and retract unequal distances in response to axial movement of the mandrel (32). For example, fewer than three stabilizer elements can be provided or several stabilizer elements with different degrees of extension may be used if asymmetrical stabilization is desired.

Although the pistons (98) in the preferred embodiment are round, they may also be elongated or may be any other shape and a set of pistons (98) may include only one piston (98). The stabilizer elements may also include stabilizer blades which in the preferred embodiment may be connected to the sets of pistons (98) and in particular to the outer radial surfaces (104) of the pistons (98). The stabilizer blades if used may be of any suitable shape, configuration or material.

The stabilizer (32) may also include an adjustable sleeve associated with the stabilizer elements which is capable of rotation relative to the stabilizer elements so that the adjustable gauge stabilizer (30) of the present invention can function as a non-rotating sleeve type adjustable gauge stabilizer.

Figure 14:
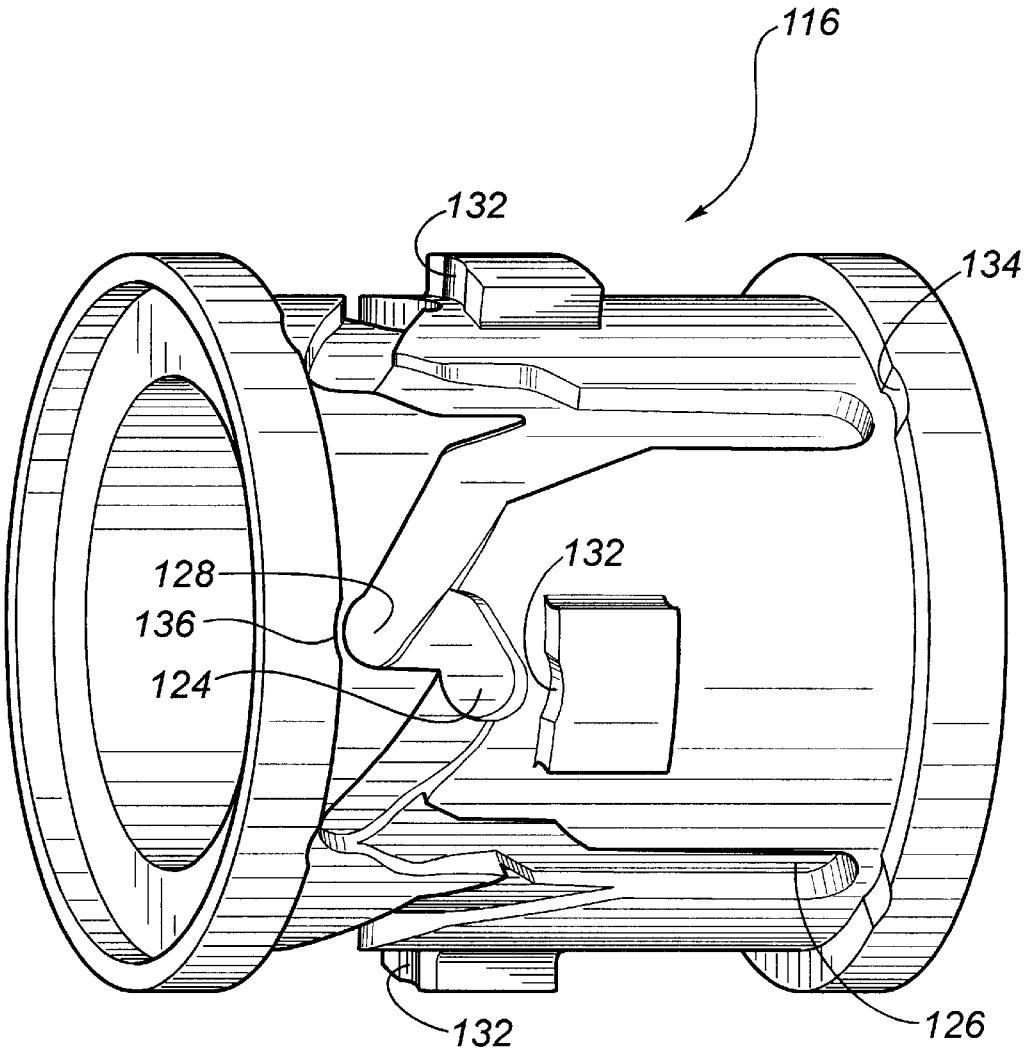
FIG. 14 is a pictorial view of a barrel cam according to a preferred embodiment of the present invention.

The barrel cam mandrel (94) and its associated components provide an indexing mechanism to facilitate movement of the stabilizer (30) between various positions. In the preferred embodiment, the stabilizer (30) may be moved between a retracted position, an extended position and a rest position. A tubular barrel cam (116) is rotatably mounted on the barrel cam mandrel (94) and is supported by an upper thrust bearing (118) and a lower thrust bearing (120). The barrel cam (116) is thus contained in the mandrel chamber (80) and is capable of rotation relative to the mandrel (32). Referring to FIG. 14, the barrel cam (116) includes a continuous groove (122) around its external circumference. A first position (124) in the groove (122) corresponds to a first maximum downward position of the mandrel (32) in which the stabilizer (30) is in the retracted position. A second position (126) in the groove (122) corresponds to a second maximum downward position of the mandrel (32) in which the stabilizer (30) is in the extended position. A third position (128) in the groove (122) corresponds to a maximum upward position of the mandrel in which the stabilizer (30) is in the rest position. There are two locations in the groove (122) corresponding to each of the first position (124), the second position (126) and the third position (128), with the two locations being separated by 180°. The groove (122) varies in depth about the circumference of the barrel cam (116).

The barrel cam further includes a first shoulder (132) at each of the two first positions (124) in the groove (122), a second shoulder (134) at each of the two second positions (126) in the groove (122), and a third shoulder (136) at each of the two third positions (128) in the groove (122).

The barrel cam (116) is held on the barrel cam mandrel (94) by the nut mandrel (92) which is connected to the barrel cam mandrel (94) with a threaded connection and a barrel cam nut (130) which is connected to the nut mandrel (92) with a threaded connection.

In the preferred embodiment, the piston housing (50) includes a pair of barrel cam bushings (138) which are separated by 180°. These barrel cam bushings (138) protrude into the mandrel chamber (80) adjacent to the barrel cam (116). At least one of these barrel cam bushings (138) is equipped with a barrel cam pin (140) which also protrudes into the mandrel chamber (80) for engagement with the groove (122) in the barrel cam (116). The barrel cam pin (140) is spring loaded so that it is urged into the mandrel chamber (80) but is capable of limited radial movement in order to enable it to move in the groove (122) about the entire circumference of the barrel cam (116) as the barrel cam (116) rotates relative to the mandrel (32) and the housing (22).

The variable depth groove (122) in the barrel cam (116) includes steps along its length so that the barrel cam pin (140) can move only in one direction in the groove (122) and will be prevented from moving in the other direction due to the combined effects of the spring loading of the barrel cam pin (140) and the steps in the groove (122). The groove (122) is configured so that the barrel cam pin (140) will move in sequence in the groove (122) to the first position (124), the third position (128), the second position (126), the third position (128), the first position (124), the third position (128), the second position (126), the third position (128) and so on. In other words, the stabilizer (30) always moves through the rest position between movements from the retracted position to the extended position or vice versa.

As the barrel cam pin (140) moves along the groove (122) to the first position (124), the barrel cam bushings (138) will function as stop lugs and will engage the first shoulders (132) on the barrel cam (116) to support the mandrel (32) axially relative to the housing (22). Similarly, as the barrel cam pin (140) moves along the groove (122) from the first position (124) to the third position (128) and then to the second position (126), the barrel cam bushings (138) will engage the third shoulders (136) and the second shoulders (134) on the barrel cam (116) respectively to support the mandrel (32) axially relative to the housing (22).

Other types and configurations of indexing mechanisms may be utilized in the invention, provided that they perform the function of regulating axial movement of the mandrel (32) relative to the housing (22).

In the preferred embodiment, the drive shaft (66) is supported radially by radial bearings at three locations along its length. First, a lower drive shaft bearing (142) is provided adjacent to the lower end (36) of the housing (22). More particularly, the lower drive shaft bearing (142) is located in an annular space between the bottom housing cap (52) and the lower drive shaft (74), and is mounted on the lower drive shaft (74) for rotation with the lower drive shaft (74) with a ball and retainer assembly (144). The lower drive shaft bearing (142) thus rotates relative to the bottom housing cap (52).

Second, the lower drive shaft (74) is supported by a mid drive shaft bearing (146) which is located in an annular space between the lower drive shaft (74) and the mid bearing mandrel (91). In the preferred embodiment, the mid drive shaft bearing (146) is mounted on the lower drive shaft (74) for rotation with the lower drive shaft (74). The mid drive shaft bearing (146) thus rotates relative to the mid bearing mandrel (91).

Rotation of the mandrel (32) with the mid drive shaft bearing (146) or with the drive shaft (66) is inhibited by a stop pin (149) located on the piston housing (50) which protrudes inside the housing (22) to engage an axial groove (151) in the outer surface of the mid bearing mandrel (91). The stop pin (149) travels axially in the groove (151) during axial movement of the mandrel (32) but does not permit any significant rotational movement between the housing (22) and the mandrel (32). The stop pin (149) and groove (151) also function to inhibit axial movement of the mandrel (32) beyond either the second maximum downward position or the maximum upward position.

Third, the drive shaft cap (70) is supported by an upper drive shaft bearing (150) which is located in an annular space between the bearing housing (44) and the drive shaft cap (70). In the preferred embodiment, the upper drive shaft bearing (150) is mounted on the bearing housing (44) with set screws (152) and the drive shaft cap (70) therefore rotates relative to the upper drive shaft bearing (150).

In the preferred embodiment, the lower drive shaft bearing (142), the mid drive shaft bearing (146) and the upper drive shaft bearing (150) are all fused tungsten carbide coated journal type bearings which are lubricated with circulating fluid, but other types of radial bearing and means of lubrication may be utilized. In addition, the number and location of the radial bearings may be varied as long as adequate radial support for the drive shaft (66) is provided.

In the preferred embodiment the spring mandrel (90) and its associated components provide a biasing device for urging the mandrel (32) toward the upper end (34) of the housing (22). The spring mandrel (90) defines a spring chamber (154) in an annular space between the spring mandrel (90) and the indexing housing (48). A lower spring stop (156) is positioned in the spring chamber (154) toward its lower end. An upper spring stop (160) is positioned in the spring chamber (154) at its upper end and abuts a spring shoulder (162) located on the spring mandrel (90). A return spring (164), a spring cap (166) and a spring thrust bearing (168) are contained in the spring chamber (154) between the lower spring stop (156) and the upper spring stop (160). The function of the spring thrust bearing (168) is to permit the return spring (164) to rotate in the spring chamber (154) during its extension and compression.

The return spring (164) is capable of extension and compression in the spring chamber (154) through a range corresponding at least to the permitted axial movement of the mandrel (32) between the rest position and the extended position. The return spring (164) exerts an upward force on the spring shoulder (162) which tends to move the mandrel (32) toward the upper end (34) of the housing (22).

Other forms of biasing mechanism may be utilized in the invention. For example, other forms of spring or even compressed gases could be contained in the spring chamber (154).

In the preferred embodiment, the upper mandrel (88) functions as part of a balancing piston assembly (170) and also provides an upper end (84) of the mandrel (32) which communicates with the fluid passage (24) to effect downward axial movement of the mandrel (32) when circulating fluid is circulated through the assembly (20).

The lower end of the upper mandrel (88) defines a balancing piston chamber (174) located in an annular space between the upper mandrel (88) and the indexing housing (48). The balancing piston chamber (174) contains an annular balancing piston (176) which is axially movable in the balancing piston chamber (174). The balancing piston (176) includes seals (178) on its inner radius and its outer radius which engage the outer surface of the upper mandrel (88) and the inner surface of the indexing housing (48) respectively and which prevent fluid from passing by the balancing piston (176) in the balancing piston chamber (174).

In the preferred embodiment, a wellbore fluid compartment (180) is defined by that portion of the balancing piston chamber (174) which is located above the balancing piston (176). One end of an oil compartment (182) is defined by that portion of the balancing piston chamber (174) which is located below the balancing piston (176).

The function of the wellbore fluid compartment (180) is to expose the balancing piston (176) to the downhole pressure of the wellbore adjacent to the assembly (20). A wellbore fluid port and filter plug (184) are located on the indexing housing (48) adjacent to the wellbore fluid compartment (180) and communicate with the wellbore fluid compartment (180) for this purpose. Since the wellbore fluid compartment (180) should be exposed to the downhole pressure of the wellbore and not the pressure through the interior of the assembly (20), a seal is provided near the upper end (84) of the mandrel (32) to prevent wellbore fluids from escaping the wellbore fluid compartment (180) and to prevent other fluids from entering the wellbore fluid compartment (180).

The oil compartment (182) extends axially from the balancing piston (176) to the bulkhead (82) in an annular space located between the housing (22) and the mandrel (32). The function of the oil compartment is twofold. First, it serves to lubricate the various components associated with the spring chamber (154), the barrel cam (116) and the stabilizer (30). Second, the oil compartment (182) transmits the downhole pressure of the wellbore from the balancing piston (176) to the stabilizer (30), and in particular to the inner radial surfaces (102) of the pistons (98) so that only the differential pressure required to overcome the upward force exerted on the mandrel (32) by the return spring (164) will be necessary to move the mandrel (32) toward the lower end (36) of the housing (22) and thus extend the stabilizer elements. A sealable oil compartment filling port (186) is provided in the piston housing (50) to allow filling of the oil compartment (182).

In addition, since the oil compartment (182) must be segregated from circulating fluid and from wellbore fluid, seals are provided on many of the components defining the oil compartment (182) to prevent oil from escaping the oil compartment (182) and to prevent other fluids from entering the oil compartment (182). In particular, seals are provided on the bulkhead (82) and at the points of connection between the upper mandrel (88) and the spring mandrel (90), the spring mandrel (90) and the mid bearing mandrel (91), the mid bearing mandrel (91) and the nut mandrel (160), the nut mandrel (160) and the barrel cam mandrel (94), and the barrel cam mandrel (94) and the lower mandrel (96). The piston seals (99) also provide a seal between the pistons (98) and the piston seats (100).

One of the preferred features of the present invention is the specific design of the wellbore fluid compartment (180) and the oil compartment (182), which preferably maintain a constant volume of wellbore fluid in the wellbore fluid compartment (180) regardless of the axial position of the mandrel (32) relative to the housing (22). In other words, the volume of the wellbore fluid compartment (180) is designed to remain constant. The importance of this feature is that it will reduce the action of solid materials contained in the wellbore fluid being alternately drawn into and expelled from the wellbore fluid compartment (180) as the mandrel (32) moves axially in the housing (22), which action can clog the filter plug (184) or even the entire wellbore fluid compartment (180) with solid particles which are suspended in the wellbore fluid.

This design is achieved in the preferred embodiment by ensuring that the balancing piston (176) at all times moves axially with the mandrel (32) so that the position of the balancing piston (176) relative to the mandrel (32) is constant for all axial positions of the mandrel (32). This in turn ensures that the volume of the wellbore fluid compartment (180) remains constant for all axial positions of the mandrel (32).

Referring to FIGS. 3 through 11, it can be seen that movement of the mandrel (32) relative to the bulkhead (82) from the maximum upward position to the second maximum downward position reduces the overall length of the oil compartment (182) by an amount equal to the distance travelled by the mandrel (32) and by the balancing piston (176), which in turn reduces the volume of the oil compartment (182) by an amount equal to the distance travelled by the balancing piston (176) multiplied by the cross sectional area of the balancing piston (176). As the pistons (98) move outward radially in response to downward movement of the mandrel (32), however, the volume of the oil compartment (182) adjacent to the pistons (98) increases.

As a result, the desired design effect of the preferred embodiment can be accomplished by ensuring that when the mandrel (32) is moved axially downward the increased volume of oil needed to fill the oil compartment (182)

adjacent to the pistons (98) is equal to the reduced volume of the oil compartment (182) caused by downward movement of the balancing piston (176), and by ensuring that the reverse occurs when the mandrel (32) is moved axially upward. The volume of oil displaced by axial movement of the balancing piston (176) must therefore be carefully matched with the volume of oil displaced by radial movement of the pistons (98).

In the preferred embodiment, this effect is further achieved by sizing the cross sectional area of the balancing piston (176) to match the cross sectional area of the bulkhead (82) so that the volume of that portion of the oil compartment (182) adjacent to the bulkhead (82) changes in response to axial movement of the mandrel (32) by an amount equal to the change in volume caused by movement of the balancing piston (176), which sizing simplifies the calculation of the cross sectional area of the balancing piston (176) that is required to achieve the desired design effect.

The assembly (20) is preferably equipped with a signalling device for signalling whether the mandrel (32) is in the first maximum downward position or in the second maximum downward position. This signalling device may comprise any device or means that is capable of providing the necessary indication, which preferably should include a signal that can be observed by the drilling crew who are operating the assembly (20).

Figure 3A:
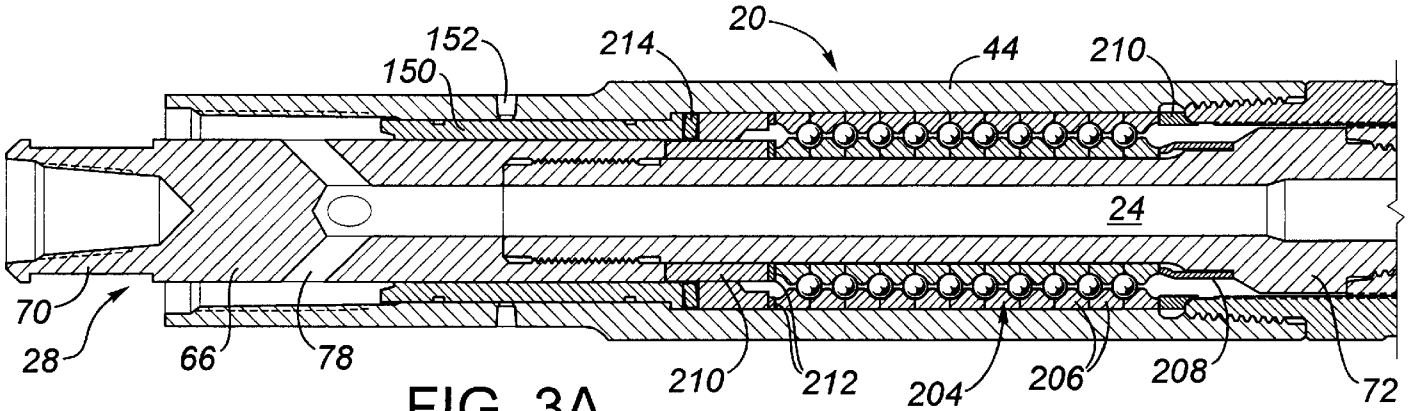
FIGS. 3, 4 and 5 together constitute a more detailed view of FIG. 2, with FIG. 4 being a continuation of FIG. 3 and FIG. 5 being a continuation of FIG. 4.
Figure 3B:
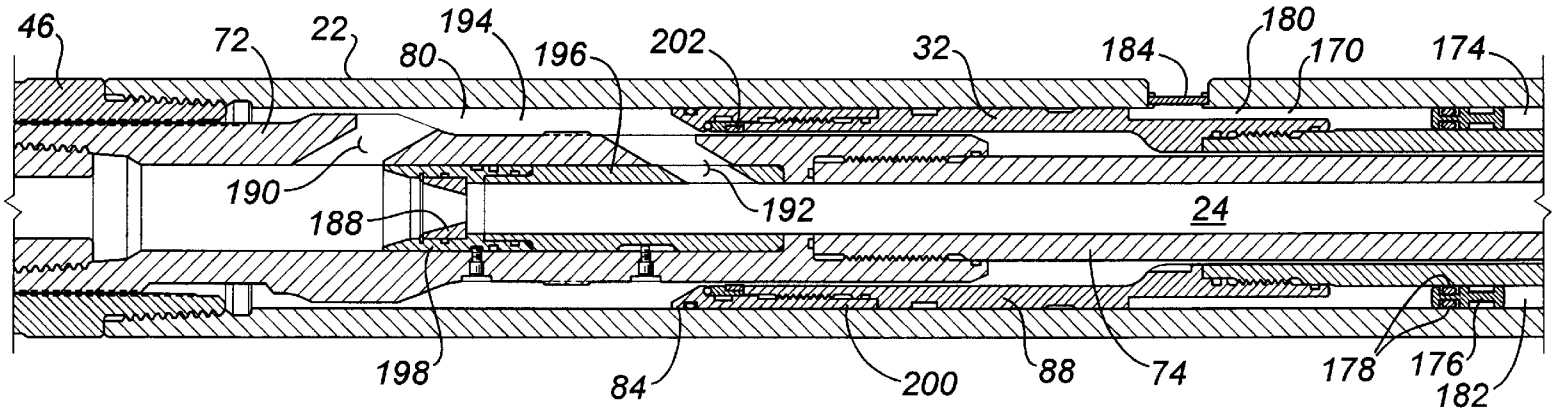
Figure 4A:
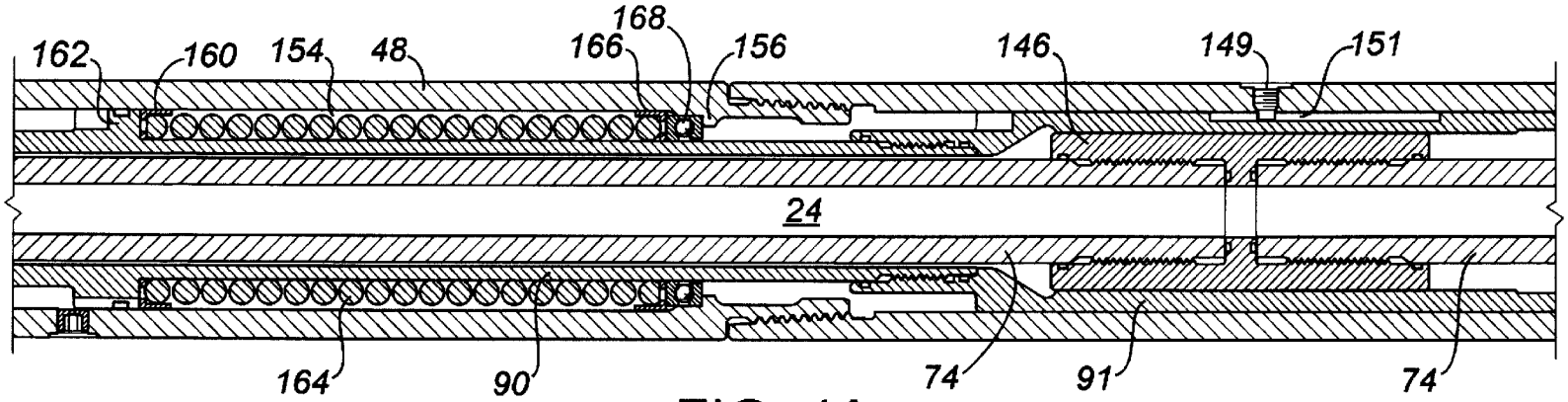
Figure 4B:
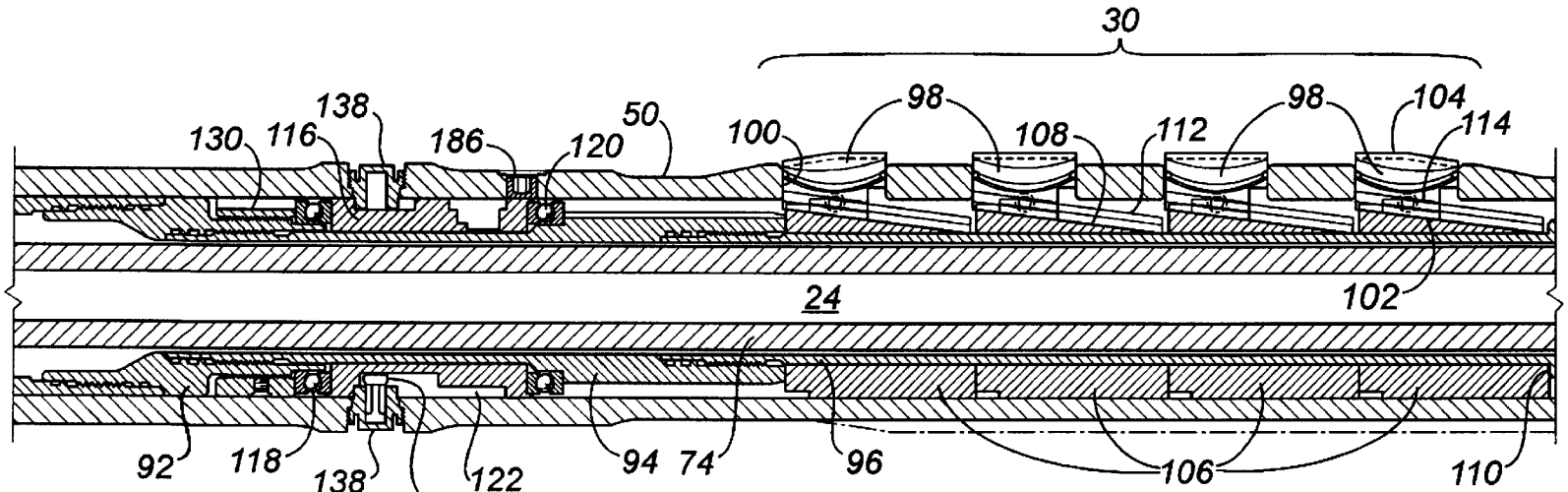
Figure 5:
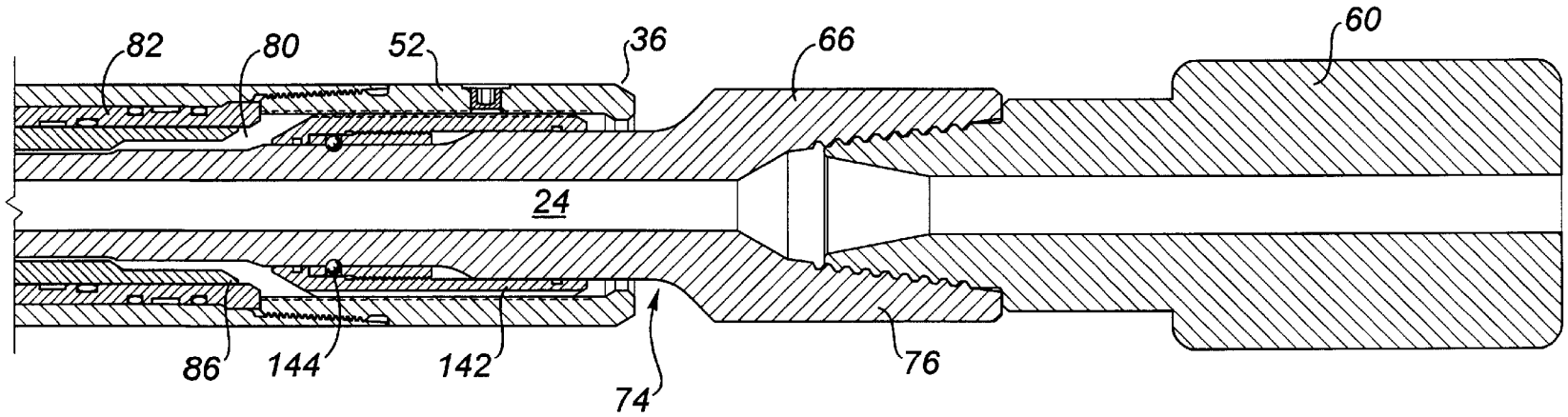

In the preferred embodiment, the upper end of the indexing housing (48), the upper mandrel (88) and the flow diverter shaft (72) cooperate to provide the signalling device. Referring to FIGS. 3, 6 and 9, the flow diverter shaft (72) includes a nozzle (188), a first diverter passage (190) and a second diverter passage (192). The nozzle (188) restricts the flow of circulating fluid through the hollow bore of the flow diverter shaft (72). The first diverter passage (190) diverts a portion of the circulating fluid into a diverter annulus (194) which is formed between the flow diverter shaft (72) and the indexing housing (48). The diverter annulus (194) is defined at its lower end by the upper end (84) of the mandrel (32).

In the preferred embodiment, the hollow bore of the flow diverter shaft (72) further includes a protective sleeve (196) which extends from downstream of the nozzle (188) to downstream of the second diverter passage (192) and which protects the bore from abrasive effects of circulating fluid and a nozzle retainer (198) which is threadably connected to the protective sleeve (196) and which holds the nozzle (188) in place.

Referring to FIG. 3, when the mandrel (32) is in the second maximum downward position so that the stabilizer elements are extended, the second diverter passage (192) diverts the portion of circulating fluid from the diverter annulus (194) back into the hollow bore of the flow diverter shaft (72). There is thus very little disruption of flow of the circulating fluid when the stabilizer elements are extended and only a minimal pressure drop will be experienced by the circulating fluid in passing through the flow diverter shaft (72). This relatively low pressure drop will translate to a relatively low output pressure at the circulating fluid pump.

Referring to FIGS. 6 and 9, when the mandrel (32) is in either the first maximum downward position or the rest position, the upper end (84) of the mandrel (32) extends upwards in the diverter annulus (194) past the second diverter passage (192) to restrict the flow of circulating fluid from the diverter annulus (194) back into the hollow bore of the flow diverter shaft (72) via the second diverter passage (192). Most of the circulating fluid must then pass through the nozzle (188) in order to flow through the assembly (20), with the result that a significant pressure drop will be experienced by the circulating fluid in passing through the flow diverter shaft (72). This relatively high pressure drop will translate to a relatively high output pressure at the circulating fluid pump.

In the preferred embodiment, the upper end (84) of the upper mandrel (88) includes an orifice retainer (200) which is threadably connected to the upper mandrel (88) and an orifice (202) which is carried by the orifice retainer (200). The function of the orifice (202) is first, to permit an amount of circulating fluid to pass in the annular space between the flow diverter shaft (72) and the upper mandrel (88) to lubricate the mid drive shaft bearing (146) and the lower drive shaft bearing (142) and second, to permit an amount of circulating fluid to return to the hollow bore of the flow diverter shaft (72) even when the mandrel (32) is in either the first maximum downward position or the rest position. The orifice (202) and the size of the annular space between the flow diverter shaft (72) and the upper mandrel (88) are designed to provide the desired amount of circulating fluid to perform both of these functions, having regard to the amount of circulating fluid necessary for lubrication of the bearings (142, 146) and the desired pressure drop to be provided by the signalling device.

The difference in output pressure at the circulating fluid pump which is caused by the position of the upper end (84) of the mandrel (32) relative to the second diverter passage (192) can be sensed from the surface by the drilling crew. The signalling device can be designed and assembled to provide different output pressures for different drilling conditions by altering the dimensions of the nozzle (188), the first diverter passage (190), the second diverter passage (192), the diverter annulus (194), the orifice (202), and the annular space between the flow diverter shaft (72) and the upper mandrel (88).

In the preferred embodiment, the bearing housing (44) includes components of a conventional bearing assembly (204) of the type commonly used in downhole drilling motor assemblies. Other bearing designs may, however be used in the invention.

The function of the bearing assembly (204) is to provide thrust and radial support to the drive shaft (66) in the housing (22). In the preferred embodiment, the bearing assembly (204) includes a double direction ball style thrust bearing (206) located in an annular space between the upper end of the flow diverter shaft (72) and the bearing housing (44). The bearing surface on the housing (22) is the upper end of the lower bearing sub (46) and the bearing surface on the drive shaft (66) is a bearing support (208) on the flow diverter shaft (72). The thrust bearing (206) is further contained by the lower end of the drive shaft cap (70). Spacers (210), shims (212) and belleville springs (214) may be provided on the housing (22) and on the drive shaft (66) to ensure that the thrust bearing (206) provides appropriate support for the drive shaft (66).

In preparation for operation of the assembly (20), the drilling bit (60) can be connected to the lower end (76) of the drive shaft (66) and the assembly (20) can be connected to the drill string (54) as part of a bottom hole assembly. Before the assembly (20) is lowered into the wellbore, however, it should be surface tested by pumping circulating fluid through the assembly (20) in cycles first, to ensure that the stabilizer (30) moves properly through its various positions and second, to determine a benchmark reading of circulating fluid pump output pressure for the signalling device in each of the different positions of the stabilizer (30) as provided for by the indexing mechanism.

The assembly (20) can then be lowered into the wellbore in order to commence drilling operations. Drilling will be performed by turning the drilling bit (60) either through rotation of the drill string (54), through circulation of fluid through the power unit (26) to rotate the drive assembly (28), or through a combination of both.

The adjustable gauge stabilizer (30) will be actuated by the difference between the pressure of the circulating fluid being passed downward through the assembly (20) and the pressure of the wellbore adjacent to the assembly (20). This pressure differential will be applied to the upper end (84) of the mandrel (32) and will provide a force tending to cause the mandrel (32) to move toward the lower end (36) of the housing (22). The downward force will be opposed by an upward force exerted on the mandrel (32) by the return spring (164). If the downward force is greater than the upward force, the mandrel (32) will move downward relative to the housing. If the downward force is less than the upward force, the mandrel (32) will remain in the maximum upward position with the barrel cam bushings (138) engaging the third shoulders (136) on the barrel cam (116).

If the mandrel (32) moves downward relative to the housing (22), it will move toward either a first maximum downward position in which the stabilizer elements are retracted and the barrel cam bushings (138) engage the first shoulders (132) on the barrel cam (116), or a second maximum downward position in which the stabilizer elements are extended and the barrel cam bushings (138) engage the second shoulders (134) on the barrel cam (116). The barrel cam pin (116) will therefore travel in the groove (122) on the barrel cam (116) as the barrel cam (116) rotates on the barrel cam mandrel (94) until it either reaches the first position (124) in the groove (122) which corresponds to the first maximum downward position of the mandrel (32) and retraction of the stabilizer elements or it reaches the second position (126) in the groove (122) which corresponds to the second maximum downward position of the mandrel (32) and extension of the stabilizer elements.

The mandrel (32) will remain "locked" in either the first maximum downward position or the second maximum downward position as long as the differential pressure applied to the mandrel (32) continues to exceed the amount necessary to move the mandrel (32) downward to that position. If the differential pressure is reduced by reducing the flow of circulating fluid through the assembly (20), the barrel cam (116) will rotate on the barrel cam mandrel (94) and the barrel cam pin (140) will travel in the groove (122) toward the third position (128) which corresponds to the maximum upward position of the mandrel (32). Once the barrel cam pin (140) reaches the maximum upward position, which corresponds to the rest position of the stabilizer elements, subsequent increase of differential pressure will move the mandrel (32) downward to the maximum downward position which was not achieved in the previous cycle.

The downward position of the mandrel (32) and thus the stabilizer (30) can be determined when fluid is being circulated through the assembly (20) by observing the output pressure of the circulating fluid pump. If the output pressure is relatively high, the mandrel (32) is in the first maximum downward position and the stabilizer (30) is retracted. If the output pressure is relatively low, the mandrel (30) is in the second maximum downward position and the stabilizer (30) is extended. If the stabilizer (30) is not in the desired position at any time during drilling operations the position may be changed by reducing the circulation of fluid through the assembly (20) and then increasing the circulation of fluid through the assembly (20) so that the mandrel (32) can move from one of the maximum downward positions to the maximum upward position and then to the other of the maximum downward positions.

It should be noted, however, that the operation of the assembly (20) is dependent upon proper cycling of the pressure of the circulating fluid being passed through the assembly (20). Unless the pressure of the circulating fluid matches or exceeds the differential pressure required to move the mandrel (32) to the next maximum downward position permitted by the indexing mechanism, the barrel cam pin (140) will be unable to progress along the groove (122). Care must therefore be taken to ensure that the differential pressures required to actuate the stabilizer (32) are compatible with the differential pressures required for both the specific drilling operation and the specific motor assembly configuration.

One advantage of the assembly (20) of the present invention is that the actuation of the adjustable gauge stabilizer (30) is dependent only upon the axial position of the mandrel (32). Since the mandrel (32) is movable independently of the housing (22) and the drive assembly (28) and is not required to support or transmit any torsional or axial loads, the actuation of the stabilizer (30) is thus independent of the weight on bit and the direction or amount of rotation of the drill string (54). Furthermore, since actuation of the stabilizer (30) is not dependent upon rotation of the drill string (54), the stabilizer (30) may still be actuated in situations where the assembly (20) does not contact the sides of the wellbore due to washout or other causes.

This advantage distinguishes the present invention from many prior art devices, and provides drilling personnel with maximum flexibility in drilling techniques, since both rotating drill string and sliding drilling can be accomplished with the stabilizer (32) in either the retracted or extended positions. It also reduces potential damage to the stabilizer (32) as the assembly (20) is being run into or out of the wellbore by providing for the rest position of the stabilizer (32) in which the stabilizer elements may actually be withdrawn past the retracted position.

We claim:

1. A downhole drilling assembly comprising the following:

(a) a housing having an upper end for connection to a drill string and a lower end;

(b) a fluid passage extending through the housing from the upper end to the lower end;

(c) a power unit contained within the housing;

(d) a drive assembly extending within the housing between the power unit and the lower end of the housing such that a mandrel chamber is defined between the drive assembly and the housing;

(e) a radially movable stabilizer associated with the housing and located between the power unit and the lower end of the housing;

(f) an axially movable mandrel contained within the mandrel chamber; and (g) a stabilizer actuator contained within the mandrel chamber and associated with both the mandrel and the stabilizer such that axial movement of the mandrel causes radial movement of the stabilizer.

2. The drilling assembly as claimed in claim 1 wherein the drive assembly is rotatable relative to the housing.

3. The drilling assembly as claimed in claim 2, wherein the mandrel is urged toward the lower end of the housing in response to a fluid being passed through the fluid passage from the upper end of the housing toward the lower end of the housing.

4. The drilling assembly as claimed in claim 3 wherein the stabilizer is capable of moving radially between a retracted position and an extended position.

5. The drilling assembly as claimed in claim 4 further comprising a biasing device for urging the mandrel toward the upper end of the housing.

6. The drilling assembly as claimed in claim 5 wherein the mandrel has an upper end and wherein the upper end of the mandrel communicates with the fluid passage such that the mandrel is urged toward the lower end of the housing in response to the fluid being passed through the fluid passage from the upper end of the housing toward the lower end of the housing.

7. The drilling assembly as claimed in claim 5 wherein the stabilizer comprises at least one stabilizer element, wherein each stabilizer element comprises a set of pistons spaced axially along the housing.

8. The drilling assembly as claimed in claim 7 wherein each piston has an inner radial surface which extends into the mandrel chamber when the stabilizer is in the retracted position.

9. The drilling assembly as claimed in claim 8 wherein the stabilizer actuator comprises a set of ramp rings which move axially with the mandrel, each ramp ring having a ramped outer surface for engagement with the inner radial surface of one of the pistons to effect radial movement of the piston.

10. The drilling assembly as claimed in claim 9 wherein the ramped outer surface of each ramp ring increases in radial dimension in a direction toward the upper end of the housing, so that the set of pistons is moved radially outward in response to movement of the mandrel toward the lower end of the housing.

11. The drilling assembly as claimed in claim 7 wherein the stabilizer comprises a plurality of stabilizer elements spaced circumferentially around the housing.

12. The drilling assembly as claimed in claim 11 wherein each stabilizer element further comprises a stabilizer blade connected to the set of axially spaced pistons.

13. The drilling assembly as claimed in claim 5 wherein the stabilizer has an inner radial surface which extends into the mandrel chamber when the stabilizer is in the retracted position.

14. The drilling assembly as claimed in claim 13 wherein the stabilizer actuator comprises a ramped outer surface for engagement with the inner radial surface of the stabilizer to effect radial movement of the stabilizer.

15. The drilling assembly as claimed in claim 14 wherein the ramped outer surface of the stabilizer actuator increases in radial dimension in a direction toward the upper end of the housing, so that the stabilizer is moved radially outward in response to movement of the mandrel toward the lower end of the housing.

16. The drilling assembly as claimed in claim 13 wherein the stabilizer comprises an outer radial surface, further comprising a balancing piston assembly associated with the mandrel chamber so that when the drilling assembly is in use, a pressure exerted on the outer radial surface of the stabilizer is substantially the same as a pressure exerted on the inner radial surface of the stabilizer.

17. The drilling assembly as claimed in claim 5, further comprising an indexing mechanism associated with the mandrel for controlling the axial movement of the mandrel so that the mandrel is capable only of limited axial movement.

18. The drilling assembly as claimed in claim 17 wherein the indexing mechanism provides for a first maximum downward position of the mandrel in which the stabilizer is in the retracted position and provides for a second maximum downward position of the mandrel in which the stabilizer is in the extended position.

19. The drilling assembly as claimed in claim 18 wherein the indexing mechanism provides for a maximum upward position of the mandrel in which the stabilizer is in a rest position.

20. The drilling assembly as claimed in claim 19 wherein the indexing mechanism comprises a barrel cam rotatably contained in the mandrel chamber and axially movable with the mandrel and a barrel cam pin associated with the housing for engagement with a circumferential groove defined by an external surface of the barrel cam.

21. The drilling assembly as claimed in claim 20, further comprising a stop lug associated with the housing and a first shoulder, a second shoulder and a third shoulder associated with the barrel cam, wherein the stop lug engages the first shoulder when the mandrel is at the first maximum downward position, wherein the stop lug engages the second shoulder when the mandrel is at the second maximum downward position and wherein the stop lug engages the third shoulder when the mandrel is at the maximum upward position.

22. The drilling assembly as claimed in claim 19, further comprising a signalling device for signalling whether the mandrel is in the first maximum downward position or the second maximum downward position.

23. The drilling assembly as claimed in claim 22 wherein the fluid undergoes a pressure drop as it passes through the fluid passage, and wherein the signalling device comprises a flow diverter associated with the fluid passage and the mandrel, which flow diverter causes the pressure drop to be different when the mandrel is in the first maximum downward position than when the mandrel is in the second maximum downward position.

24. The drilling assembly as claimed in claim 5, further comprising at least one bearing contained in the housing for rotatably supporting the drive assembly in the housing.

25. The drilling assembly as claimed in claim 24, further comprising a drilling bit attached to the drive assembly adjacent to the lower end of the housing.

* * * * *